US006043471A

United States Patent [19]

Wiseman et al.

[11] Patent Number: 6,043,471

[45] Date of Patent: Mar. 28, 2000

[54] MULTIPLE HEAD INDUCTIVE HEATING SYSTEM

[75] Inventors: Donald H. Wiseman, Neenah; Steven J. Geissler, Little Chute, both of Wis.

[73] Assignee: Illinois Tool Works Inc., Glenview, Ill.

[21] Appl. No.: 09/188,462

[22] Filed: Nov. 9, 1998

Related U.S. Application Data

[63] Continuation of application No. 08/636,161, Apr. 22, 1996, abandoned.

[51] Int. Cl.[7] ..... H05B 6/06; H05B 6/44

[52] U.S. Cl. ..... 219/662; 219/656; 219/665; 219/639

[58] Field of Search ..... 219/656, 662, 219/663, 665, 671, 635, 639, 640

[56] References Cited

U.S. PATENT DOCUMENTS

| | | |
|---|---|---|
| Re. 33,467 | 12/1990 | Steck et al. . |
| 1,566,500 | 12/1925 | Northup . |
| 2,429,819 | 10/1947 | Jordan . |
| 2,549,930 | 4/1951 | Riegel et al. . |
| 3,272,954 | 9/1966 | Seulen et al. . |
| 3,466,528 | 9/1969 | Adams . |
| 3,737,611 | 6/1973 | Killiar . |
| 3,743,808 | 7/1973 | Kasper . |
| 3,746,825 | 7/1973 | Pfaffmann . |
| 3,823,362 | 7/1974 | Bailey . |
| 3,953,700 | 4/1976 | Sindt . |
| 4,112,286 | 9/1978 | Alderman et al. . |
| 4,120,712 | 10/1978 | Sindt . |
| 4,280,038 | 7/1981 | Havas et al. . |
| 4,293,363 | 10/1981 | Wakabavashi et al. . |
| 4,327,268 | 4/1982 | Frank . |
| 4,382,275 | 5/1983 | Glennon . |
| 4,506,131 | 3/1985 | Boehm et al. . |
| 4,511,956 | 4/1985 | Dewan et al. . |
| 4,528,057 | 7/1985 | Challenger et al. . |
| 4,578,553 | 3/1986 | Yamashita et al. . |
| 4,602,139 | 7/1986 | Hutton et al. . |
| 4,637,199 | 1/1987 | Steck et al. . |
| 4,650,947 | 3/1987 | Hutton et al. . |
| 4,654,495 | 3/1987 | Hutton et al. . |
| 4,668,851 | 5/1987 | Kupper . |
| 4,677,535 | 6/1987 | Kawabata et al. . |
| 4,769,519 | 9/1988 | Hall . |
| 4,776,980 | 10/1988 | Ruffini . |
| 4,816,633 | 3/1989 | Mucha et al. . |
| 4,845,332 | 7/1989 | Jancosek et al. . |
| 4,847,746 | 7/1989 | Rilly et al. . |
| 4,853,832 | 8/1989 | Stuart . |
| 4,950,348 | 8/1990 | Larsen . |
| 5,025,123 | 6/1991 | Pfaffman et al. . |
| 5,031,088 | 7/1991 | Tanaka . |
| 5,343,023 | 8/1994 | Geissler . |
| 5,504,309 | 4/1996 | Geissler . |
| 5,773,799 | 6/1998 | Maxfield et al. . |

FOREIGN PATENT DOCUMENTS

| | | |
|---|---|---|
| 2663491 | 6/1990 | France . |
| 3040820A1 | 5/1982 | Germany . |
| 3710085A1 | 10/1988 | Germany . |

OTHER PUBLICATIONS

Miller®, The Miller IHC Controller, Apr. 1995.

Miller®, Owner's Manual, IHC, Apr. 1994.

Fluxtrol™ Manufacturing, Inc. Fluxtrol advanced induction technoogy.

*Primary Examiner*—Philip H. Leung
*Attorney, Agent, or Firm*—George R. Corrigan

[57] ABSTRACT

A system and method for inductively heating a workpiece includes a controller and a plurality of power supplies that receive and send signals to the controller. Induction heads receive power from the power supplies. The induction heads may be aligned with adjacent segments of the workpiece, and can span the perimeter of the workpiece. The gap between adjacent induction heads is less than one half the size of the adjacent induction heads, and preferably the induction heads abut or substantially abut. Each of the power supplies include feedback for controlling the power delivered to the segments of the workpiece. In alternative embodiments the feedback may be based on the current or power provided to the induction heads, or the power provided to the workpiece.

23 Claims, 5 Drawing Sheets

FIG. 4

MULTIPLE HEAD INDUCTIVE HEATING SYSTEM

This is a continuation of application Ser. No. 08/636,161 filed on Apr. 22, 1996 now abandoned.

BACKGROUND OF THE INVENTION

Technical Field

The present invention relates generally to induction heaters and, in particular, to inductive heating systems having multiple heads.

Background Art

Induction heating is a well known method for producing heat in a localized area on a susceptible metallic object. Induction heating involves applying an AC electric signal to a heating loop or coil placed near a specific location on or around the metallic object to be heated. The varying or alternating current in the loop creates a varying magnetic flux within the metal to be heated. Current is induced in the metal by the magnetic flux, thus heating it. Induction heating may be used for many different purposes including curing adhesives, hardening of metals, brazing, soldering, and other fabrication processes in which heat is a necessary or desirable agent or adjurant.

The prior art is replete with electrical or electronic power supplies designed to be used in an induction heating system, many of which have inverter power supplies. Such inverter power supplies typically develop high frequency signals, generally in the kilohertz to megahertz range, for application to the work coil. Because there is generally a frequency at which heating is most efficient with respect to the work to be done, some prior art inverter power supplies operate at a frequency selected to optimize heating. Heat intensity is also dependent on the magnetic flux created, therefore some prior art induction heaters control the current provided to the heating coil, thereby attempting to control the heat produced.

One example of the prior art representative of induction heating system having inverters is U.S. Pat. No. 4,092,509, issued May 30, 1978, to Mitchell. Mitchell discloses numerous inverter circuits for powering induction heaters. The circuits are designed to operate in the twenty to fifty kilohertz range, allegedly to maximize induction heating efficiency. To the extent Mitchell discloses controlling the magnitude of the magnetic flux, and therefore controlling the heat created by the induction heater, switches are used to select between one of two inverter circuits. For example, in FIG. 40, switches 404 and 407 are moved to positions 404A and 407A, respectively, or to positions 404B and 407B, respectively, to select between high power output and low power output.

Another type of induction heater in which the output is controlled by turning an inverter power supply on and off is disclosed in the U.S. Pat. No. 3,475,674, issued Oct. 28, 1969, to Porterfield, et al. The average output power of the induction heater described by Porterfield varies in accordance with the ratio of the time during which the inverter is off compared to the time during which the inverter is on.

Another known induction heater utilizing an inverter power supply is described in U.S. Pat. No. 3,816,690, issued Jun. 11, 1974, to Mittelmann. Mittelmann describes an induction heater having a variable frequency inverter power supply. The frequency of operation of the inverter is said to be selected to provide the maximum efficiency of energy transfer between the output of the inverter and the inductance element used to heat the workpiece. In order to provide the proper amount of heat to the workpiece, Mittelmann monitors the watt-seconds delivered to the output of the inverter. In response to the measured watt-seconds, Mittelmann selectively turns the inverter on and off. Thus, the average heat delivered by the induction heater is controlled.

Each of the above methods to control power delivered by an induction heater either is not adjustable in frequency and/or does not adequately control the heat or power delivered to the workpiece by the heater. The prior art induction heaters described in U.S. Pat. Nos. 5,343,023 and 5,504,309 (also assigned to the present assignee) provide frequency control and a way to control the heat or power delivered to the workpiece. These induction heating systems include an induction head, a power supply, and a controller. They have been used in groups, wherein a one-to-one correspondence between the induction head, power supply and controllers existed.

One use of induction heaters is to cure (or partially cure) adhesives in the automotive industry. Generally, an adhesive is provided around the perimeter of an automotive part, such as a door. As used herein perimeter means near the edge, away from the center of the workpiece, or where the adhesive is applied. An induction heater is used to cure (or in some cases partially cure) the adhesive by heating the door adjacent the adhesive. During the curing process, a door with an adhesive disposed around the perimeter rests in a nest and the induction heads are placed around and/or in close proximity to the workpiece. Power is then provided to the induction heads, which heat portions of the door near the head, and the adhesive is cured or partially cured to the desired degree. A similar application entails the use of metallic based adhesives. These adhesives have metallic substances added to the adhesive which are directly heated by induction.

In order to properly cure the adhesive, the amount of energy delivered to the work piece by the head must be adequately controlled. This energy depends on, among other things, the energy delivered to the head, the losses in the head, and the relative position of the head to the workpiece (which affects coupling). However, in many applications, particularly ones in which the distance from the head to the workpiece is difficult to control precisely, such as automotive applications, the distance from the head to the workpiece can vary at different locations on the workpiece. Thus, it may be difficult to control the energy delivered or to apply energy evenly to the various portions of the workiece being heated.

There are at least two prior art arrangements used to inductively heat a large workpiece. One is to provide an induction coil shaped to generally coincide with the shape of the part to be cured. Thus, the entire perimeter of the part (such as an automotive door) is heated, and the adhesive is cured along this perimeter. The other arrangement is to have a number of induction heads, each of which cures a spot or selected portion of the perimeter, and each of which is connected in series to a single power source. Both of these arrangements are described in U.S. Pat. No. 4,950,348.

However, both of these arrangements have significant failings. Both provide a single current (either to each part of one head, or to each of several heads). If the door or other part is not precisely situated in the nest, the relative head to workpiece distance may vary along the part perimeter, and the heat (or energy or power) delivered to the workpiece is not uniform around the workpiece, thus the desired heating is not obtained. Also, the "spot curing" arrangement is undesirable because it does cure the entire perimeter, thus the curing is non-uniform.

Thus, it is desirable to provide a method and apparatus that inductively heats a workpiece using multiple heads, each of which may be separately controlled to provide the desired heat. Additionally, it is preferable that such a method and apparatus be capable of inductively heating an entire perimeter of a workpiece. Moreover, it is preferable that multiple induction heads heating the perimeter be separately controllable, so that a more uniform heating may be obtained.

Additionally, prior art controllers used in the induction heating area do not provide adequate fault warning. Generally the prior art simply provides a fault light that is illuminated during a heating cycle if a fault is detected in the cycle. While that may be adequate to indicate a problem exists, it does nothing to show what the problem is or how that problem may be corrected.

Accordingly, it is desirable to provide an induction heating system that provides fault detection and records the faults so that proper adjustments may be made.

SUMMARY OF THE INVENTION

A system for inductively heating a workpiece in accordance with one aspect of the invention comprises a controller and a number of power supplies that receive and send signals to the controller. A number of induction heads receive power from one of the power supplies.

In accordance with a second aspect of the invention the induction heads align with adjacent segments of the workpiece to be cured. In one alternative, the induction heads span the perimeter of the workpiece. The gap between adjacent induction heads is less than one half the size of the adjacent induction heads, and preferably the inductions abut or substantially abut.

A third aspect of the invention is that the controller and each of the power supplies include feedback for controlling the power delivered to the segments of the workpiece. In alternative embodiments the feedback may be based on the current or power provided to the induction heads, or the power provided to the workpiece.

A fourth aspect of the invention is a method for inductively heating a workpiece. The method includes aligning a plurality of induction heads with adjacent segments of the workpiece providing power to each of the induction heads, wherein the gap between adjacent induction heads is less than one-half the size of the adjacent induction heads. In other embodiments the induction heads are connected to one or more of power supplies and each power supply is controlled.

A fifth aspect of the invention includes the method above, including the step of aligning the induction heads with adjacent segments of the perimeter of the workpiece to be cured, and spanning the perimeter of the workpiece. Feedback is used to control each induction head in another aspect of the invention. In alternative embodiments the feedback may be based on current or power to the head, or power to the workpiece.

Another aspect of the invention is a continuous segmented perimeter induction heating system. The system may include feedback, and may cover the entire perimeter of the workpiece.

DETAILED DESCRIPTION OF A PREFERRED EXEMPLARY EMBODIMENT

Figure 1:
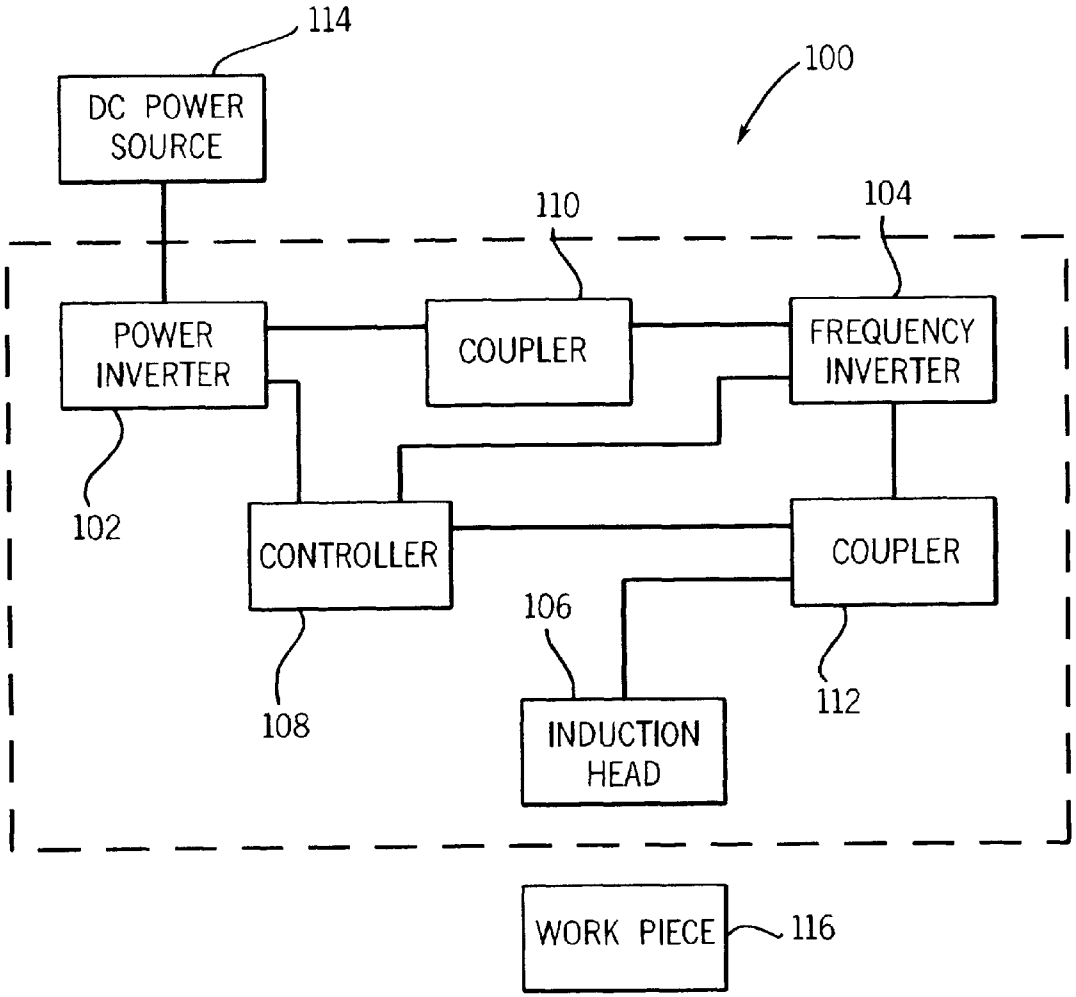
FIG. 1 is a block diagram of an induction heater.

Before explaining at least one embodiment of the invention in detail it is to be understood that the invention is not limited in its application to the details of construction and the arrangement of the components set forth in the following description or illustrated in the drawings. The invention is capable of other embodiments or being practiced or carried out in various ways, and it should be understood that the preferred embodiments are but one of many embodiments. Also, it is to be understood that the phraseology and terminology employed herein is for the purposes of description and should not be regarded as limiting.

The present invention relates to an induction heater and heating system such as one used to cure an adhesive for adhering a piece of metal to another object. The system may include multiple heads and power supplies to provide control of the energy delivered to the workpiece, and preferably includes a fault detection and recording system.

Generally, the use of multiple heads with multiple power supplies and a single controller in accordance with the present invention may be done with a wide variety of feedback mechanisms and controllers. However, for the purpose of completeness one example of a controller and power circuitry is described below. The specific controller and feedback system described should not be considered limiting.

Referring to FIG. 1 an induction heater, designated generally as 100, includes a power inverter 102, an output inverter 104, an induction head 106, a controller 108, and couplers 110 and 112. Also shown in FIG. 1 is a workpiece 116, which induction heater 100 heats, and a DC power source 114.

In operation, power inverter 102 receives DC power from DC power source 114. Alternatively, the power source may be an AC power source, and a rectifier may be provided, so that power inverter 102 receives a rectified AC power supply. Power inverter 102 then inverts the DC power supply signal, and to control the inverted signal pulse width modulates the inverted signal (also called phase control of the inverter signal), and thus provides an AC signal at a first frequency that is high enough to respond quickly to feedback signals (but preferably not so fast as to cause stress to the inverter components). Coupler 110 then rectifies the AC signal to provide a second DC signal having a magnitude dependent upon the pulse width or phase modulation of the AC signal power inverter 102.

The second DC signal, the output of coupler 110, is applied to output inverter 104. Output inverter 104 inverts the DC signal a frequency selected to optimize heating given the induction head being used. The frequency may be factory set, user adjustable, or dependent on the LC time constant of the output circuit (which includes an induction coil and capacitors). The magnitude of the AC signal is dependent upon the magnitude of the DC input signal, and is thus responsive to the pulse width modulation of power inverter 102. The AC signal is transformed by coupler 112 and is applied to induction head 106.

The AC current through induction head 106 induces current in workpiece 116, thus causing workpiece 116 to heat at the location adjacent induction head 106. The heat intensity produced in workpiece 116 is dependent upon the magnetic flux induced in the workpiece. The magnetic flux in turn is responsive to the magnitude of the signal provide by output inverter 104, and thus also is responsive to the phase modulation of power inverter 102. Controller 108 is provided to control the pulse width modulation of power inverter 102, and the frequency of operation of output inverter 104.

Figure 2:
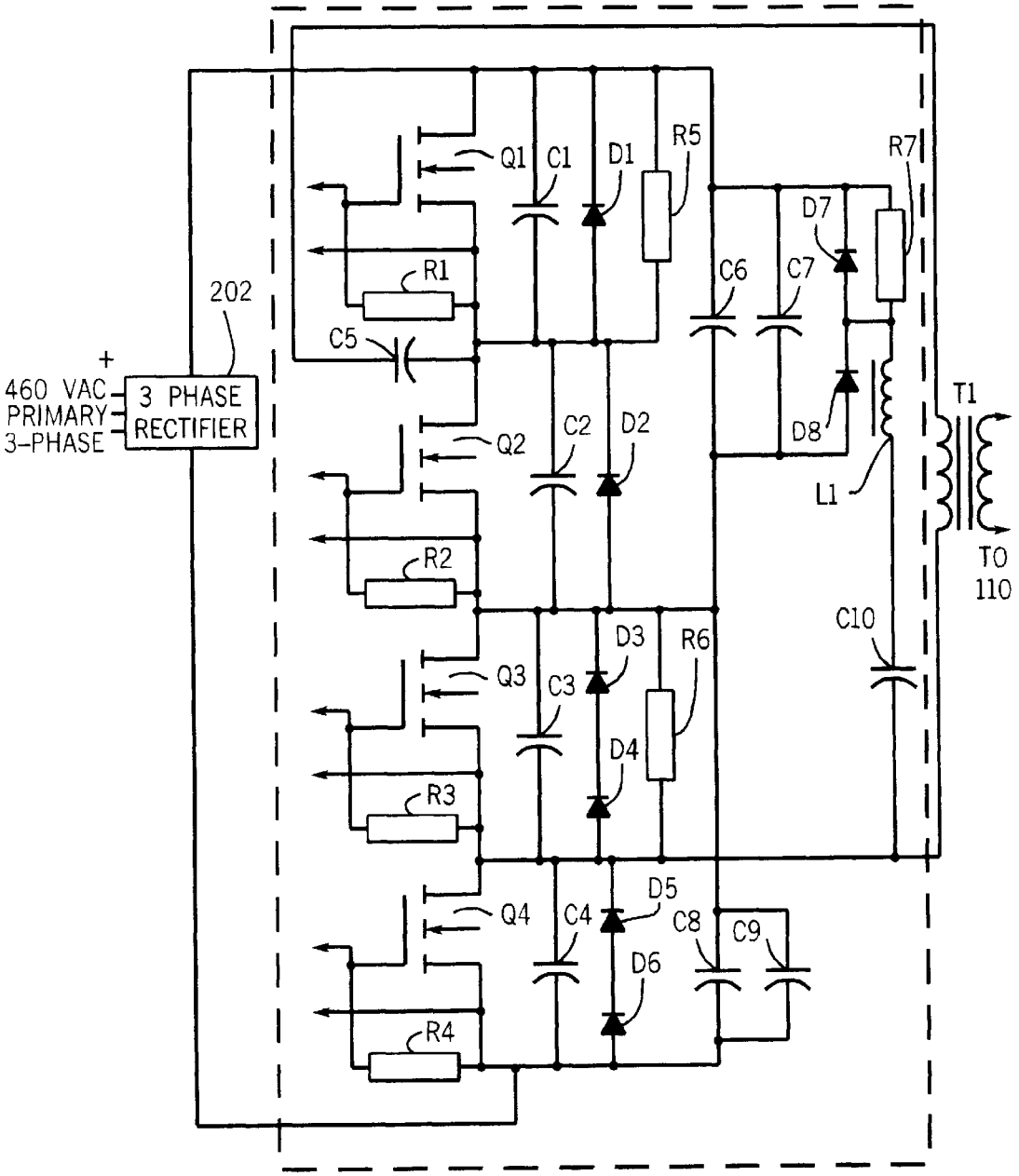
FIG. 2 is a circuit diagram of the power inverter shown in FIG. 1.

Referring now to FIG. 2, power inverter 102 is shown along with a three phase rectifier 202. Power inverter 102 is shown to include a plurality of MOSFETs Q1–Q4, a plurality of capacitors C1–C10, a plurality of diodes D1–D8, a plurality of resistors R1–R7 and an inductor L1. A transformer T1, which is part of coupler 110, is also shown. In operation three phase rectifier 202 preferably provides up to 100 amps at 1200 volts by rectifying a 460 volt, three phase AC signal.

In general there are two mutually exclusive current paths for providing current flow first in one direction through the primary transformer T1 and then in the opposite direction through the primary of transformer T1. The current paths are: first, from the positive output of three phase rectifier 202 through MOSFET Q1, capacitor C5, the primary of transformer T1, MOSFET Q4, and back to the negative output of the rectifier; and, second, from capacitor C5, through MOSFET Q2, MOSFET Q3, the primary of transformer T1, and back to capacitor C5. These paths are selected by turning MOSFETs Q1 and Q4 on and MOSFETs Q2 and Q3 off, or conversely, by turning MOSFETs Q2 and Q3 on and MOSFETs Q1 and Q4 off.

In operation capacitor C5 is charged to about 325 volts, or one half of the 650 volt supply. Thus, when MOSFETs Q1 and Q4 are on, ignoring voltage drops across MOSFETs Q4 and Q1, approximately 325 volts (650 volt supply minus 325 volts across capacitor C5) is applied to the primary of transformer T1, with the upper terminal of the primary being positive with respect to the lower terminal.

When MOSFETs Q2 and Q3 are on and MOSFETs Q1 and Q4 are off, approximately 325 volts is applied across the primary of transformer T1 in the opposite direction. Capacitors C6–C9 are provided to tie the voltage between MOSFETs Q2 and Q3 to 325 volts, or one-half of the rectified input. When MOSFETs Q2 and Q3 are on, the voltage between MOSFET Q2 and capacitor C5 is tied to the voltage at the node common to MOSFETs Q2 and Q3 and capacitors C6–C9, or about 325 volts. The voltage across capacitor C5, which is an 8 microfarad high current polypropylene capacitor, is 325 volts, and due to the large capacitance of capacitor C5, will not change quickly. Thus, the voltage applied to the top of the primary of transformer T1 is zero volts. Also, through MOSFET Q3 and capacitors C6–C9, 325 volts is applied to the bottom of the primary of transformer T1. Thus, turning MOSFETs Q2 and Q3 on causes 325 volts to be applied to transformer T1, but in the reverse direction of the 325 volts applied by turning on MOSFETs Q1 and Q4.

In order to pulse width modulate, or phase control, the signal applied to the primary of transformer T1, MOSFETs Q1 and Q2 are turned on and off at a constant frequency, preferably about 50 kilohertz. MOSFETs Q1 and Q2 are 180 degrees out of phase, and each has a duty cycle of 50%. MOSFETs Q3 and Q4 also have duty cycles of 50% and are 180 degrees out of phase from one another. Also, MOSFETs Q3 and Q4 are slaved to MOSFETs Q2 and Q1, respectively, in that they may be turned on from zero to 180 degrees out of phase with respect to the respective time MOSFETs Q1 and Q2 are on. Because a pulse is applied to the primary of transformer T1 only when both MOSFETs Q1 and Q4 are on, or when both MOSFETs Q2 and Q3 are on, the phase of MOSFET Q4 relative to MOSFET Q1, and the phase of MOSFET Q3 relative to MOSFET Q2, determines the pulse width of the signal applied to the primary of transformer T1. Because MOSFETs Q3 and Q4 are 180 degrees out of phase of one another, they are each out of phase with respect to MOSFETs Q2 and Q1, respectively, by an identical amount.

For example, when MOSFET Q3 is zero degrees out of phase with respect to (in phase with) MOSFET Q2, MOSFET Q3 will be on the entire half cycle that MOSFET Q2 is on, and a pulse for the full half cycle will be applied to the primary of transformer T1. Also, if MOSFET Q3 is in phase with MOSFET Q2, then MOSFET Q4 will be in phase with MOSFET Q1, and a pulse for the full other half cycle will also be provided to the primary of transformer T1. Conversely, when MOSFET Q3 is 180 degrees out of phase with respect to MOSFET Q2, MOSFET Q3 will be off the entire half cycle that MOSFET Q2 is on, and no pulse will be applied to the primary of transformer T1. Again, MOSFET Q4 will also be 180 degrees out of phase with respect to MOSFET Q1, and no pulse will be provided on the other half cycle.

In general, because MOSFET Q3 is out of phase with respect to MOSFET Q2 by the same amount that MOSFET Q4 is out of phase with respect to MOSFET Q1, in steady state operation the opposite polarity pulses will have the same width. Thus, the width of the 325 volt pulses applied to the primary of transformer T1 is dependent upon the phase of MOSFET Q4 with respect to MOSFET Q1, and the phase of MOSFET Q3 with respect to MOSFET Q2.

Accordingly, to control the total current output of power inverter 102, controller 108, which may include a conventional pulse width modulator, applies signals to the gates of MOSFETs Q1–Q4 and controls the phase of MOSFETs Q3 and Q4 with respect to MOSFETs Q2 and Q1. Alternatively, controller 108 may include a plurality of timers such as a CMOS 4098 dual timer, available from Harris Semiconductor, and a flip-flop, to provide the control of MOSFETS Q1 and Q2. To provide the control of MOSFETS Q3 and Q4, which are slaved to Q2 and Q1, a comparator may be used, having its output connected to a flip-flop and having as inputs a ramp generator and a signal having a magnitude dependent on the desired phase difference between MOSFETS Q1/Q2, and Q4/Q3. Thus, a pulse may be narrow or wide, even though in steady state operation all MOSFETs have a 50% duty cycle, to help insure that high heat build up does not occur in MOSFETs Q1–Q4, to protect the components. It may be desirable to provide a deadband, wherein, for example, the turning on of Q1 or Q3, is delayed slightly from the turning off of Q2 or Q4, respectively, so that Q2 or Q4 will be completely off before Q1 or Q3 is on.

Capacitors C1–C4 are small polypropylene snubbing capacitors and diodes D1–D6 and resistors R5 and R6 are provided to protect MOSFETs Q1–Q4. Capacitors C6 and C8 are large electrolytic capacitors, typically 1700 microfarads and split the voltage provided by three phase rectifier 202 to one-half of the supply voltage at the node common to MOSFETs Q2 and Q3. Capacitors C7 and C9 are 8 microfarad high current polypropylene capacitors, provided to smooth the voltage seen by the node common to MOSFETs Q2 and Q3. Diodes D7 and D8 and resistor R7 and inductor L1, along with capacitor C10 are provided to prevent unbalancing of the node common to MOSFETs Q2 and Q3. Specifically, when capacitors C6 and C7 have a voltage across them other than that of capacitors C8 and C9, inductor L1 acts as a spillover inductor and causes the voltage across capacitors C6 and C7 to become equal to that across capacitors C8 and C9. Resistors R1–R4 protect the gate of MOSFETs Q1–Q4.

Figure 3:
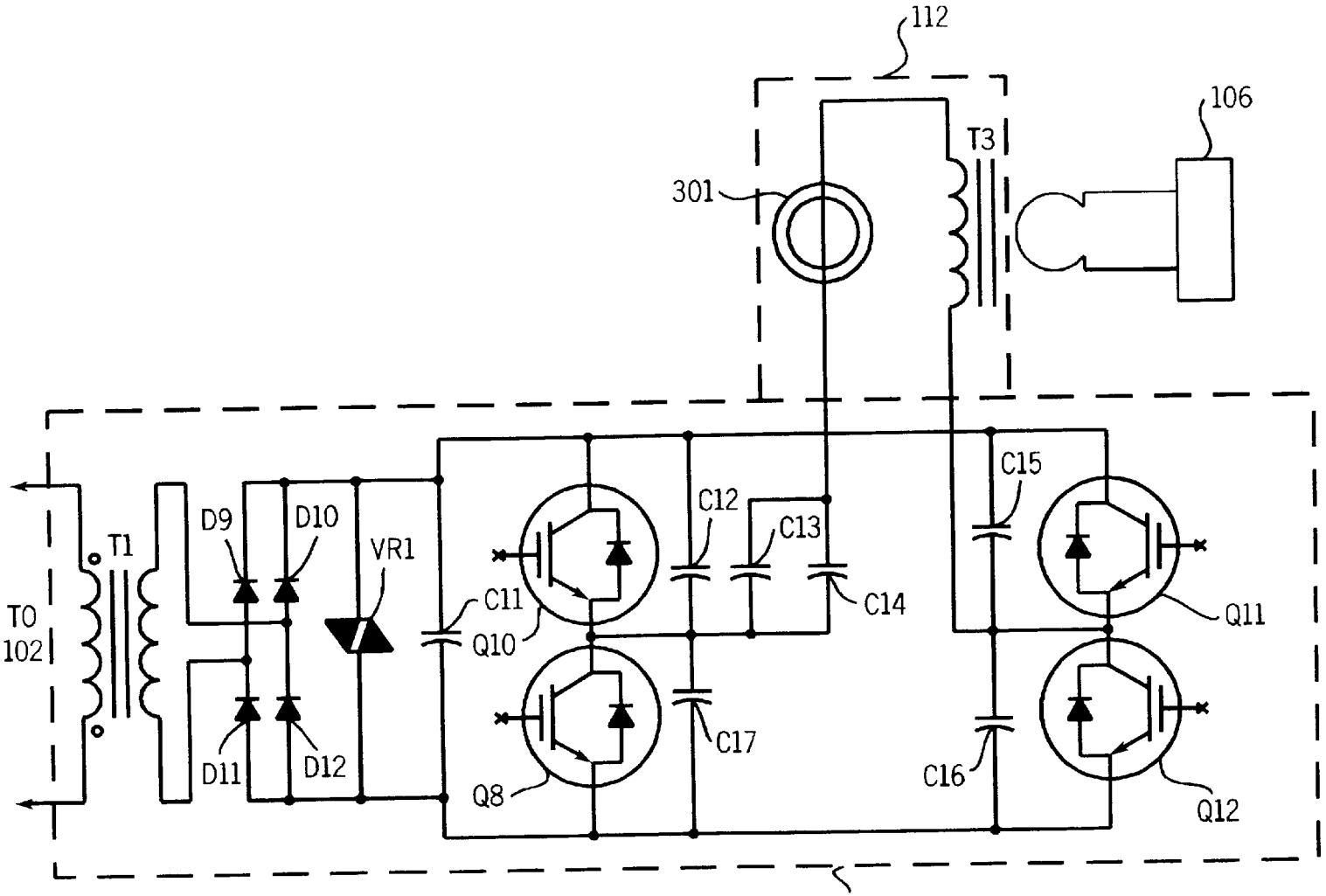
FIG. 3 is a circuit diagram of the frequency inverter shown in FIG. 1.

Referring now to FIG. 3 coupler 110, output inverter 104, coupler 112 and induction head 106 are shown. Coupler 110 includes transformer T1, a plurality of diodes D9–D12, a voltage regulator VR1, and a capacitor C11.

The primary of transformer T1 is connected to the output of power inverter 102. As described above, the primary of transformer T1 receives a pulse width modulated AC signal at a desired frequency, exemplified herein to be about 50 KHz. The width of the pulses is determined by phase controller 108 as described above. The secondary of transformer T1 is connected to a diode bridge comprised of diodes D9–D12, which rectifies the AC signal. The rectified signal is applied to capacitor C1 causing a voltage across it. Voltage regulator VR1 is provided to ensure that the voltage across capacitor C11 is not greater than a predetermined limit, selected to protect the components of the inverter. The voltage across capacitor C11 is directly responsive to the total current induced in the secondary of transformer T1, which is responsive to the width of the pulses generated by power inverter 102. The DC voltage across capacitor C11 is provided as the DC input to output inverter 104.

Output inverter 104 may be a conventional inverter operable at a preset or user adjustable frequency of, e.g., between 10 KHz and 1 MHz, but preferably between 25 KHz and 50 kHz. The frequency range may be higher or lower, depending on the required use of the induction heater. Accordingly, output inverter 104 may include transistors Q10–Q13 and capacitors C12–C17. Transistors Q10 and Q12 are turned on and off in unison and transistors Q11 and Q13 are turned on and off in unison. Moreover, whenever transistors Q10 and Q12 are on transistors Q11 and Q13 will be off. It may be necessary to provide a dead band wherein, before turning on one pair of transistors, the other pair is allowed to turn off. Controller 108 provides the appropriate on and off signals to the gates of transistors Q10–Q13. Capacitors C12 and C15–C17 are provided to eliminate switching losses when transistors Q10–Q13 are switched off. Capacitors C13 and C14 are provided to block DC current through an output transformer T3, to prevent saturation of transformer T3.

The output of output inverter 104 is provided to coupler 112. Coupler 112 includes a current feedback device 301, which is a ferrite toroidal core with a sixty turn secondary and a single turn primary. The single turn primary is connected to the primary of transformer T3. The output of current feedback device 301 is provided to controller 108 which adjusts the pulse width of power inverter 102 in a conventional manner. In addition to the current feedback, a voltage feedback may be provided to controller 108. Controller 108 may then determine the power (voltage multiplied by current) delivered to induction head 106.

Controller 108 may also determine the heat lost in the induction head 106 due to the resistance of the induction head, which will be the current squared, multiplied by the resistance of induction head 106. The difference between the power delivered and the power lost in the induction head is equal to the power delivered to workpiece 116. The multiplication may be carried out using known multiplier chips such as an MPY634 KP chip available from Burr Brown, and the subtraction may be carried out with an operational amplifier (op amp). The output of output inverter 104 is provided through a primary winding on transformer T3, which may preferably be a coaxial transformer, and induces a current in a secondary winding of transformer T3, which is a two turn loop that is applied to induction head 106 in one embodiment. Accordingly, as output inverter 104 drives current through the primary of transformer T3 at the operating frequency, a current of the same frequency is induced in induction head 106, thereby heating workpiece 116.

The present invention will also work well with feedback mechanisms other than the specific feedback mechanism set forth above. For example, a temperature monitor could be used on the workpiece. Alternatively, other electrical characteristics (various combinations of current, voltage, power and energy) of the induction head and or power supplies, or feedback systems described in the prior art, could be used. Thus, the present invention is contemplated to be used with virtually any feedback mechanism, as the precise mechanism is not important to the invention.

Figure 4:
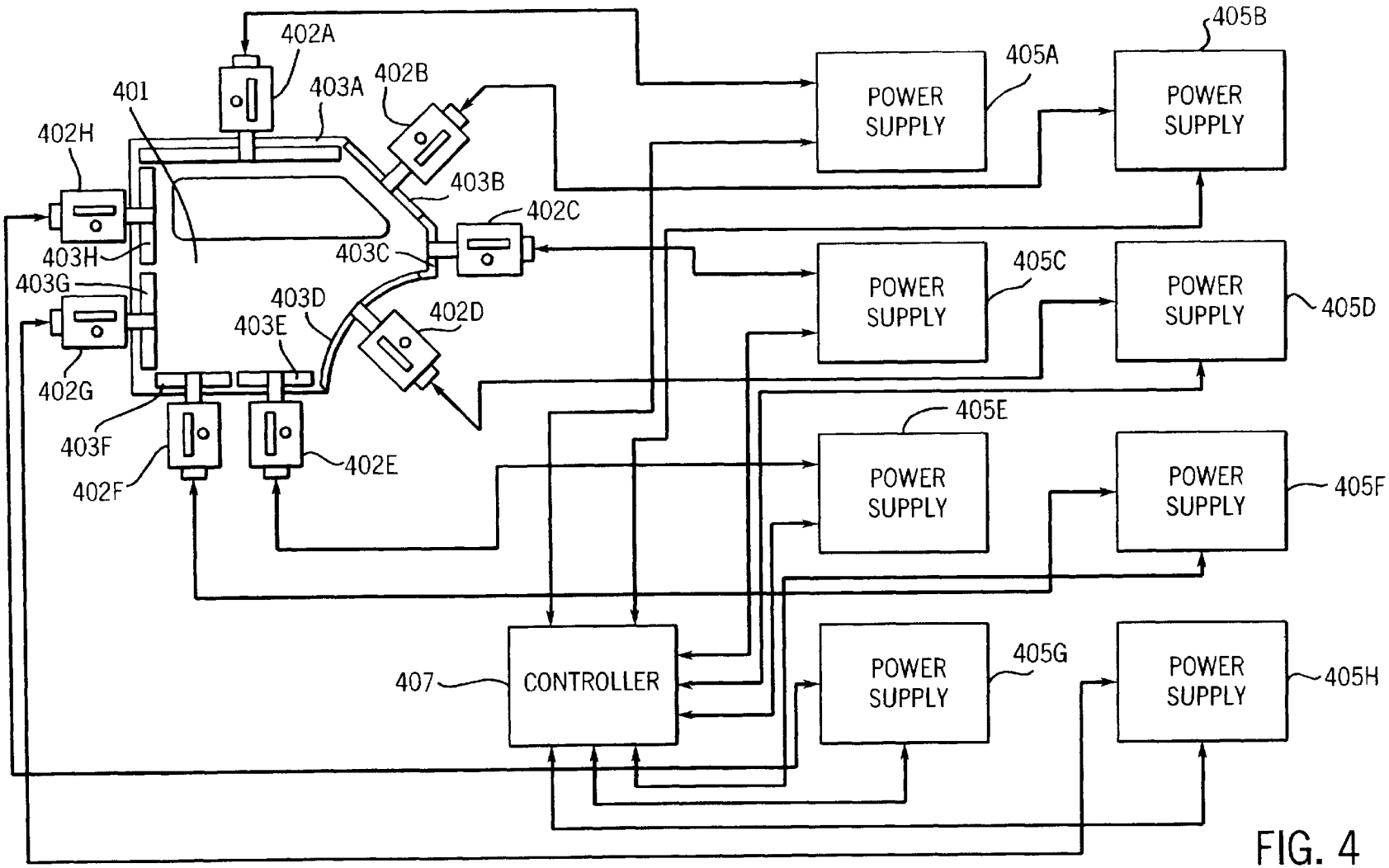
FIG. 4 is a block diagram of a multiple head induction heater constructed in accordance with the present invention.

Referring now to FIG. 4, a multiple head induction heating system made in accordance with the present invention is shown. The exemplar system shown is used to cure the perimeter, or portions of the perimeter, of an automobile door 401 with a plurality of induction heads 403A–403H. Induction heads 403A–403H are formed so as to align with the perimeter of the workpiece, (door 401 in this example). Each induction head 403A–403H is connected to a matching transformer 402A–402H.

Each matching transformer 402A–402H is connected to a power source 405A–405H. Each power source 405A–405H includes circuitry to receive an input power and provide an appropriate AC signal to the matching transformer and head, which couples the signal to the induction head. For example, in the preferred embodiment each power source 405A–405H includes a power inverter, a coupler and an output inverter, such as that shown in FIGS. 1–3. However, the invention should not be considered limited to the preferred embodiment shown above, rather any suitable induction heating power source will suffice.

In the preferred embodiment each of the power sources 405A–405H is connected to a controller 407. Controller 407 includes a mini-computer or microprocessor and is used to program time and power parameters for each of the power sources 405A–405H. In the preferred embodiment, controller 407 is used to ensure that each induction head 403A–403H is used for the proper amount of time and receives the proper amount of power. Additionally, as shown schematically, signals are provided from the matching transformers to the power sources to provide feedback, such as that described above.

Thus, using a feedback system such as that described with reference to FIGS. 1–3, each power source may separately adjust the power being delivered to the matching transformer and respective induction head so that the proper amount of heat is delivered to workpiece 401. For example, feedback is provided from induction head 403A and matching transformer 402A to power source 405A. Depending upon the desired power and the feedback signal, power source 405A adjusts the current delivered to induction head 403A so that the proper amount of energy is delivered to workpiece 401. If, for example, induction head 403B is not situated in the precisely desired location, then power source 405B increases the current delivered to matching transformer 402B so that more current is delivered to induction head 403B, to compensate for the improper positioning. A signal indicative of the desired heat is provided by controller 407 to the respective power sources 405A–405H. In one alternative embodiment the controller is integral with a power source. Also, multiple power sources may be networked.

As can be seen, the present invention allows for curing the entire perimeter of a workpiece, but also allows for that curing to be done in segments so that the energy delivered to the workpiece may be more precisely controlled for each portion of the workpiece. This novel arrangement is referred to as a continuous segmented perimeter inductive heating system. The segments generally cover the entire perimeter of the workpiece (or a continuous portion thereof), except for the gaps between the induction heads, which are smaller than the heads themselves. In the preferred embodiment adjacent heads abut or nearly abut one another. In other embodiments adjacent heads overlap.

As one skilled in the art will recognize, any of a number of feedback systems could be used. Additionally, an open loop system could be used. In either case the advantage of having a segmented perimeter curing system may be taken advantage of to allow control of individual segments of the workpiece. If a feedback system is used, it is not important what type of feedback is used. Also, the specific embodiment of the power source does not matter, just so long as the power source may be connected to the induction head (preferably but not necessarily through a matching transformer).

Alternative arrangements include having the heads cover only a portion of the workpiece, or having a dedicated controller for each head and power supply. In this alternative, the heads may form segments that cover all or part of the perimeter of the workpiece. Another arrangement is to use multiple heads that cover a portion or all of the perimeter of the workpiece, and connect the heads to a single power supply.

Another novel aspect of the present invention is the use of controller 407. In one embodiment, controller 407 is a microprocessor based computer. Having, for example, an 8051 microprocessor therein. In a single head embodiment an 806196KB microprocessor is used. The microprocessor provides as outputs, information to power sources 403A–403H which indicate the desired heat time and power to be used for the induction heating process. Controller 407 includes, in the preferred embodiment, a program which allows the recording of a fault condition in the induction heating process. Also, controller 407 provides for additional input/output control, such as turning auxiliary equipment on or off. For example, a quench pump at the end of the heat cycle may be turned on to cool the workpiece, or a clamp may be activated before the heating begins. This input/output control is particularly useful for non-automotive applications.

Controller 407 also displays process parameters in real time. For example, the voltage current frequency and power being delivered to the work piece can be displayed in real time. This is helpful to tune the system, specifically the user can add capacitance, boost the frequency or adjust the current output based upon the observed real time process parameters.

Controller 407 detects when a fault in the process occurs, and records operating parameters (such as current, frequency, voltage, power etc.) When the heating cycle is completed, controller 407 allows the user to access the recorded data to the cause of the fault, and how to correct the fault. Also, a fault light is illuminated (either when the fault occurs or at the end of the heating cycle) to notify the user that a fault occurred.

Many different types of faults can be detected, and in the preferred embodiment a fault can occur when the frequency, power consumption, bus voltage, output current, or line voltage varies from nominal values, or when a semiconductor fails. For example, an over-frequency fault occurs when the frequency is greater than approximately 65 kilohertz. This condition indicates that the capacitor used to match head impedance may not have enough capacitance (or the head is shorted). An owner's manual can indicate the proper corrective action, such as attaching a larger capacitor, when a fault occurs.

The fault correction may be more automated in alternative embodiments. For example, controller 407 may include the required corrective action in a look up table, and then indicate both the fault and the corrective action to the user. Another alternative embodiment is to have controller 407 send signals which automatically cause capacitors to be relinked in a proper configuration. This sort of automated action may be taken with other faults as well.

Another fault that is detected is an under frequency fault. When the frequency drops below approximately 3 kilohertz it is likely that either too much capacitance has been used or there is an open coil situation (the coil is open circuited).

Controller 407 also monitors the power consumed by the workpiece. If the power consumption is less than that asked for (by approximately 2% in the preferred embodiment) then a fault is recorded.

This fault generally indicates that the workpiece is improperly positioned with respect to the head (or vise versa). Controller 407 also detects a fault when a significant voltage imbalance on the input busses occurs. Many power supplies receive a 460 V input and divide it to two 230 volt busses. However, in the event of a part failure, the buses may become imbalanced. Thus, controller 407 monitors for bus imbalance and indicates a fault when the bus becomes imbalanced (by one bus exceeding approximately 420 volts in the preferred embodiment).

Additionally, in the preferred embodiment, controller 407 monitors the input line voltage. If the line voltage varies approximately plus or minus 20% from the nominal line voltage, controller 407 indicates a fault has occurred and records the operating parameters. Controller 407 also monitors for semiconductor failure. Specifically controller 407 looks for high pulse current, such as greater than 100 amps on the primary. Such a high pulse current indicates an IGBT or other switch failure in the inverter, and controller 407 indicates a fault and records the data.

Figure 5:
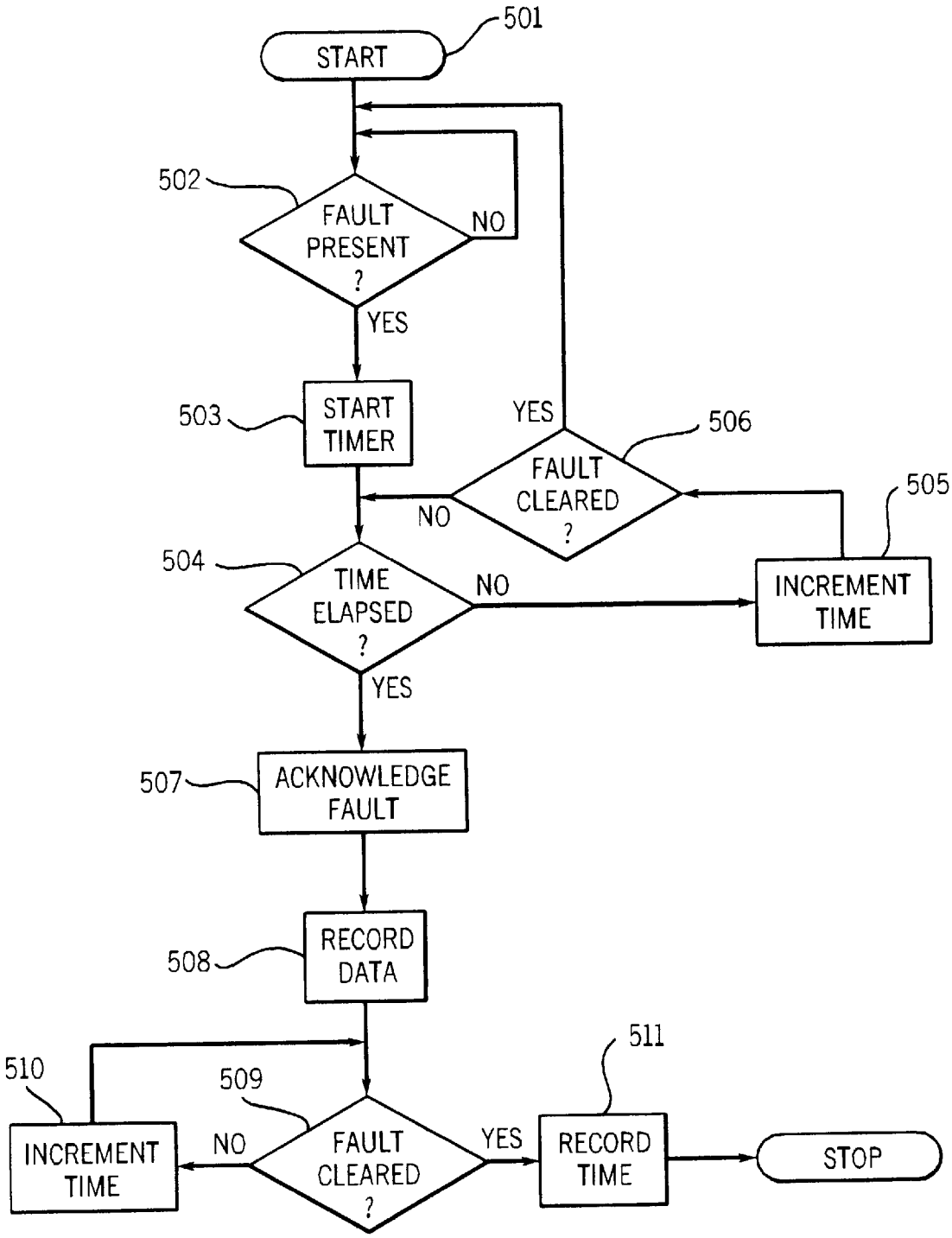
FIG. 5 is a flow chart showing the operation of a controller in accordance with the present invention.

FIG. 5 is a flow chart showing one embodiment of a program used by controller 407 to monitor and record fault data. The flow chart begins at step 501, and in step 502 it is determined if a fault is present. The faults that are monitored for can be any fault the programmer desires, but in the preferred embodiment are of those described above. If no fault is present the program recycles and rechecks again for a fault to be present. If a fault is present, the timer started at step 502.

After the timer is started, a determination of whether or not a predetermined amount of time has passed is made at step 503. In the preferred embodiment the predetermined amount of time is one quarter second. In other words, a fault must exist for at least 250 milliseconds before data is recorded and the fault is indicated as being present. If the time has not elapsed, then the time is incremented at step 504, and in step 505 it is determined if the fault has cleared. If the fault has cleared the process restarts by checking for a fault again at step 501. If the fault has not been cleared the length of time the fault has been present is redetermined at step 503. Thus the program will loop through monitoring whether or not the fault is present and checking the time until the fault clears or 250 milliseconds has elapsed.

If 250 milliseconds has elapsed, then a fault is acknowledged at step 504. This can include illuminating a light on the controller front panel. After the fault is acknowledged data is recorded at step 505. In the preferred embodiment voltage, current, frequency and power are recorded. However in alternative embodiments other operating parameters may be recorded. The data recorded may be provided to the user on a screen, by printer or other output device. Data from multiple faults (five e.g.) may be recorded and provided to the user.

After the data is recorded it is determined if the fault has cleared at step 507. If the fault hasn't cleared at step 507, the time is incremented at step 508. The time continues to increment until the fault is cleared (as determined at step 507). Thus, the length of time the fault is present is also determined. At step 509 the time of the fault is recorded and the program is completed. In the preferred embodiment the program can operate as a continuous loop, wherein after the fault is cleared and the time recorded at step 509 the program begins anew.

Thus it may be seen that the present invention as described in conjunction with controller 407 and the flow chart of FIG. 5 provides a method and apparatus to monitor the status of the induction heating process to record fault information if a fault occurs.

Other modifications may be made in the design and arrangement of the elements discussed herein without departing from the spirit and scope of the invention, as expressed in the appended claims.

What is claimed is:

1. A system for inductively heating a workpiece comprising:

a controller;

a plurality of power supplies configured to receive and send signals to the controller, wherein the controller controls individually each of the plurality of power supplies; and a plurality of induction heads, each configured to receive power from one of the plurality of power supplies and further configured to align with a unique one of a plurality of segments of the workpiece, wherein each segment is stationary with respect to the aligned induction head during heating.

2. The system of claim 1 wherein the plurality of segments are adjacent one another.

3. The system of claim 2 wherein the plurality of segments are on the perimeter of the workpiece, and span the perimeter of the workpiece.

4. The system of claim 1 wherein the gap between adjacent induction heads is less than one half the size of the adjacent induction heads.

5. The system of claim 1 wherein the controller and each of the plurality of power supplies include feedback means for controlling individually the power delivered to each of the plurality of segments of the workpiece.

6. The system of claim 5 wherein the feedback means is responsive to the magnitude of the current provided to each of the plurality of induction heads.

7. The system of claim 5 wherein the feedback means is responsive to the power provided to each of the plurality of induction heads.

8. A method for inductively heating a workpiece comprising the steps of aligning each of a plurality of induction heads with a unique one of a plurality of adjacent segments of the workpiece, wherein each segment is stationary with respect to the aligned head during heating, providing power to each of the induction heads from a plurality of power supplies, wherein the gap between adjacent induction heads is less than one-half the size of the adjacent induction heads, and controlling each of the plurality of power supplies individually with a single controller.

9. The method of claim 8 wherein the segments span the perimeter of the workpiece.

10. The method of claim 8 wherein the step of controlling is done in response to feedback.

11. The method of claim 10 including the step of controlling the power supplied to at least two of the plurality of induction heads in response to the current provided to the at least two induction heads.

12. The method of claim 10 including the step of controlling the power supplied to at least two induction heads in response to the power provided to the at least two induction heads.

13. A method for inductively heating a workpiece comprising the steps of:

positioning a plurality of induction heads near a workpiece such that each head is aligned uniquely with one of a plurality of segments of the workpiece, wherein each segment is stationary with respect to its aligned head during heating;

connecting the plurality of induction heads to a plurality of power supplies; and controlling individually each power supply of the plurality of power supplies with a single controller.

14. The method of claim 13 wherein the step of positioning includes the step of aligning the plurality of induction heads with a plurality of adjacent segments of the workpiece to be cured, wherein the gap between adjacent induction heads is less than one-half the size of the adjacent induction heads.

15. The method of claim 13 wherein the step of positioning includes the step of aligning the plurality of induction heads with a plurality of adjacent segments of the perimeter of the workpiece to be cured, wherein the adjacent segments span the perimeter of the workpiece.

16. The method of claim 13 including the step of controlling individually the power delivered to each of the plurality of segments of the workpiece in response to feedback.

17. The method of claim 16 including the step of controlling individually the power delivered to each of the plurality of segments of the workpiece in response to the current provided to each of the plurality of induction heads.

18. The method of claim 16 including the step of controlling individually the power delivered to each of the plurality of segments of the workpiece in response to the power provided.

19. A system for continuous segmented induction heating of a workpiece comprising a plurality of induction heads, a plurality of power supplies, wherein a unique one of the plurality of power supplies is connected to each of the plurality of induction heads, and a controller that controls individually each of the plurality of Power supplies, and wherein each head is configured to be aligned with a unique one of a plurality of segments of the workpiece and each segment is stationary with respect to its aligned head during heating.

20. The system of claim 19 wherein the plurality of induction heads are configured to align with a plurality of adjacent segments of the perimeter of the workpiece to be cured, and the adjacent segments span the entire perimeter of the workpiece.

21. The system of claim 19 wherein the controller and at least two of the plurality of power supplies include feedback means for controlling the power delivered to at least two of the plurality of segments of the workpiece.

22. The system of claim 19 wherein adjacent heads substantially abut.

23. The system of claim 19 wherein adjacent heads overlap.

* * * * *